US005997158A

United States Patent [19]

Fischer et al.

[11] Patent Number: 5,997,158

[45] Date of Patent: Dec. 7, 1999

[54] RETROFIT CANOPY LUMINAIRE AND METHOD OF INSTALLING SAME

[75] Inventors: Jerry F. Fischer, West Chester; Robert E. Kaeser, Cincinnati; Mark C. Reed, West Chester; James P. Sferra, Cincinnati; James G. Vanden Eynden, Indian Springs, all of Ohio

[73] Assignee: LSI Industries, Inc., Cincinnati, Ohio

[21] Appl. No.: 09/026,951

[22] Filed: Feb. 20, 1998

[51] Int. Cl.[6] ..... F21V 21/04

[52] U.S. Cl. ..... 362/374; 362/364; 362/375

[58] Field of Search ..... 362/222, 226, 362/147, 267, 310, 364, 368, 372, 374, 375, 408

[56] References Cited

U.S. PATENT DOCUMENTS

| | | | |
|---|---|---|---|
| 2,857,508 | 10/1958 | Klugman | 362/364 |
| 4,220,986 | 9/1980 | Matteo et al. | 362/375 |
| 4,388,681 | 6/1983 | Meyer | 362/374 |
| 4,791,539 | 12/1988 | Ewing | 362/226 |
| 5,136,493 | 8/1992 | Straus et al. | 362/374 |

*Primary Examiner*—Alan Cariaso
*Attorney, Agent, or Firm*—Wood, Herron & Evans, L.L.P.

[57] ABSTRACT

A retrofit luminaire assembly for mounting in an existing canopy fixture housing and methods of installing same. The retrofit luminaire assembly includes a planar panel having electrical control elements mounted to an upper surface of the panel. A lamp is received in a lamp socket mounted to the panel with a light-emitting section of the lamp extending away from a lower surface of the panel. A lens is mounted to the lower surface of the panel for enclosing the light-emitting section of the lamp. The panel preferably has a pair of oppositely directed pivot members which are adapted to engage with inwardly directed flanges of the canopy fixture housing to removably and pivotally support the panel for movement between a vertical, inoperative position and a horizontal, operative position. Methods of installing the retrofit luminaire assembly in the existing canopy fixture housing are also disclosed.

28 Claims, 4 Drawing Sheets

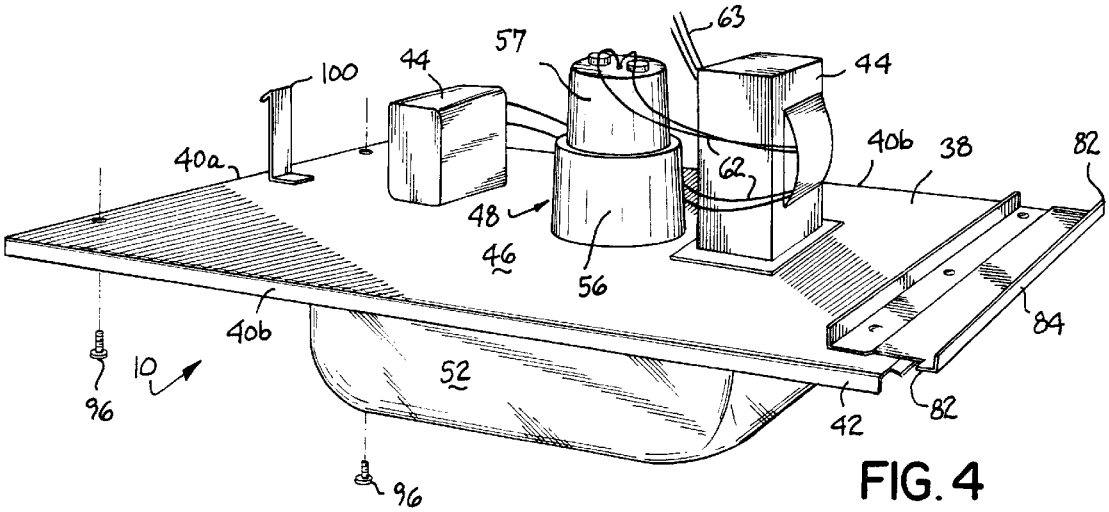
FIG. 4
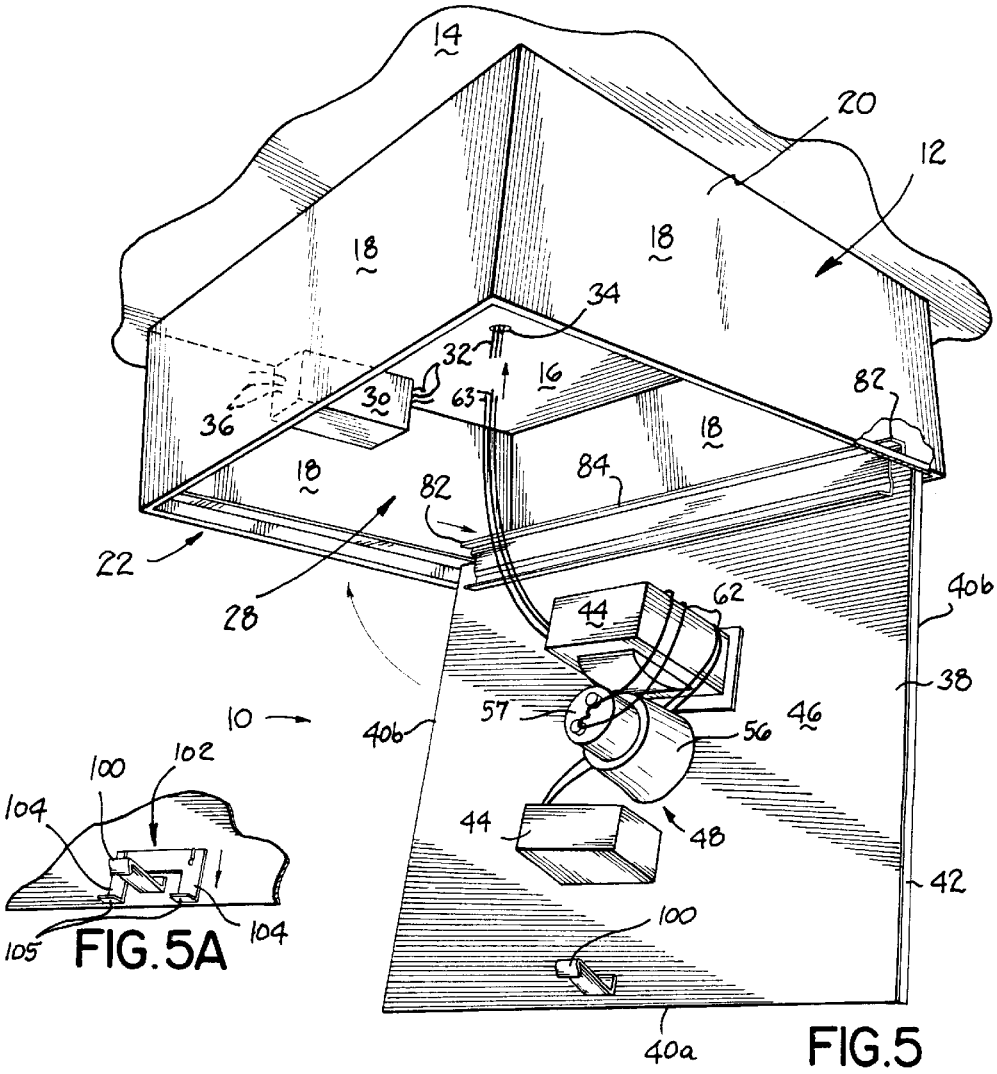
FIG.5A
FIG.5

RETROFIT CANOPY LUMINAIRE AND METHOD OF INSTALLING SAME

FIELD OF THE INVENTION

The present invention relates generally to luminaires and, more particularly, to a method and apparatus for retrofitting a luminaire mounted in a canopy fixture housing.

BACKGROUND OF THE INVENTION

Canopy luminaires are designed to provide a downward and outward distribution of light for many applications, including exterior illumination of gasoline service stations, convenience stores and drive-through restaurants, for example. Canopy luminaires typically include a box-like canopy fixture housing mounted to a horizontal ceiling or canopy support structure for enclosing and supporting lighting components and related structure of the canopy luminaire. The lighting components of the canopy luminaire include electrical control elements, such as ballasts, capacitors and ignitors, which are electrically coupled to a high intensity discharge (HID) lamp. The lamp is typically mounted horizontally in a lamp socket within the canopy fixture, and a reflector is provided above the light-emitting section of the lamp to distribute light downwardly through a glass or plastic lens assembly which encloses the lamp.

Replacement or conversion of canopy luminaires generally requires several or all of the existing lighting components and related structure of the luminaire to be removed from the existing canopy fixture housing to provide sufficient room in the fixture housing for installation of the replacement luminaire. In the past, replacement canopy luminaires have been shipped from the manufacturer as disassembled components which are then individually mounted and wired in the canopy fixture housing. It will be appreciated, however, that installation and wiring of the separate retrofit luminaire components in an existing canopy fixture installation is a complicated and time consuming process as the canopy fixture is generally only accessible by ladder. As any location or site may require replacement or conversion of ten or more canopy luminaires, the difficulty associated with installing, mounting and wiring separate retrofit components of the existing canopy luminaires is significantly increased.

Thus, there is a need for a luminaire assembly which minimizes the time required to retrofit an existing canopy luminaire. There is also a need for a luminaire assembly which improves the simplicity and ease of installation of a retrofit luminaire assembly in an existing canopy fixture housing.

SUMMARY OF THE INVENTION

To these ends, the present invention provides a retrofit luminaire assembly that is adapted to be mounted to the housing of an existing and installed canopy luminaire. The retrofit luminaire is preassembled and removable as a unit for replacing lighting components and related structure of the existing canopy luminaire, and which is designed to advantageously support the lighting components and related structure of the retrofit assembly as a unit through the installation procedure. The retrofit luminaire assembly is adapted to be suspended from the existing canopy fixture housing while the necessary electrical connections are made between the retrofit luminaire assembly and incoming power leads in the existing luminaire housing.

More specifically, the retrofit luminaire assembly in accordance with one aspect of the present invention includes a substantially planar panel having an upper surface and a lower surface. A high intensity discharge (HID) lamp is mounted to the panel with the light-emitting section of the lamp extending downwardly and away from the lower surface of the panel. A glass or plastic lens is mounted to the lower surface of the panel for enclosing the light-emitting section of the lamp. Preferably, at least one electrical control element is mounted to the upper surface of the panel and electrically coupled to the lamp. The electrical control element includes a set of electrical leads having a free end which is adapted to be spliced to the incoming power leads of the existing canopy luminaire.

The retrofit luminaire assembly preferably includes a support member mounted along one side edge of the panel which includes a pair of oppositely directed pivot members or arms formed at opposite ends of the support member. The pivot members extend perpendicularly to respectively associated side edges of the panel, which latter edges are spanned by the panel edge along which the elongated support member is mounted. Further, the pivot members lie on an imaginary line which is outboard of, and parallel to the panel side edge along which the support member is mounted. The pair of oppositely directed pivot members or arms are adapted to overlie and engage a pair of inwardly directed flanges surrounding an opening in the canopy fixture housing for removably and pivotally suspending the retrofit luminaire assembly as a unit for movement between a vertical, inoperative position and a horizontal, operative position. In the vertical, inoperative position, the retrofit canopy luminaire is completely suspended, allowing "hands free" to make the necessary electrical connections. In the suspended position, the electrical leads from the electrical control elements are accessible for coupling with the incoming power leads of the existing canopy luminaire which are located in the interior of the existing luminaire housing. In the horizontal, operative position, the panel, which is sized to be slightly larger than the opening in the canopy fixture housing, has its outer edges slightly below and outboard of the housing opening, thereby completely closing the opening in the existing canopy fixture housing.

Preferably, a resilient spring clip is mounted to the upper surface of the panel at a side edge which is opposite the panel side edge to which the support member is mounted. The resilient spring clip has an outer end which extends beyond the edge of the panel to engage an inwardly directed flange surrounding the opening in the canopy fixture housing to temporarily retain the panel in a partially closed position with its edge extending beyond and underlying the inwardly directed flange of the housing which surrounds the opening therein, facilitating attachment of threaded fasteners to maintain the panel and housing flange in snug, overlapping relationship. A slidable latch may be mounted on the upper surface of the panel proximate the resilient spring clip to retain the panel in the horizontal, operative position when the latch is moved toward one of the inwardly directed flanges of the canopy fixture housing.

In accordance with a second aspect of the present invention, a retrofit luminaire housing is mounted to the panel that includes a base and a narrow neck extending upwardly from the base. A lamp socket is mounted within the narrow neck and is accessible from the lower surface of the panel to receive the base of a lamp. A generally bowl-shaped lens configured to enclose the light-emitting section of the lamp is mounted to the base of the retrofit canopy luminaire housing. The lens includes an upper edge or rim which seals with the base of the retrofit luminaire housing to isolate the lamp and lamp socket from the environment.

Suitable hinges, clamps or clips are provided on the base of the retrofit luminaire assembly to maintain the lens in place enclosing the lamp with its upper edge or rim sealed against the base of the retrofit luminaire housing.

In accordance with a preferred method of the present invention, the existing lens assembly is first removed from the canopy fixture being retrofitted to expose the opening in the fixture housing. Electrical leads coupled between the power source and the existing ballast are disconnected, and the existing lamp and reflector are then removed from the canopy fixture housing through the opening. A retrofit canopy luminaire assembly having the features described above is suspended in the canopy fixture housing with the pair of oppositely directed pivot members or arms removably and pivotally engaging a pair of inwardly directed flanges surrounding the opening in the canopy fixture housing. The pivot members engage and support the panel of the retrofit luminaire assembly in a substantially vertical, inoperative position while the existing electrical leads from the power source associated with the existing canopy fixture housing are coupled to electrical control elements of the retrofit luminaire assembly. The panel is then pivoted to its closed horizontal, operative position and secured in place to the housing to substantially close the opening in the canopy fixture.

The above features and advantages of the present invention will be better understood with reference to the accompanying figures and detailed description.

BRIEF DESCRIPTION OF THE DRAWINGS

Reference will now be made to the accompanying figures from which the novel features and advantages of the present invention will be apparent:

FIG. 4 is a perspective view of one embodiment of the retrofit luminaire assembly shown in FIG. 1;

FIG. 5 is a perspective view showing the retrofit luminaire assembly of the present invention installed in a canopy fixture housing and supported in a vertical, inoperative position;

FIG. 5A is a partial perspective view of the optional latch shown in FIG. 2A.

DETAILED DESCRIPTION OF THE INVENTION

Figure 1:
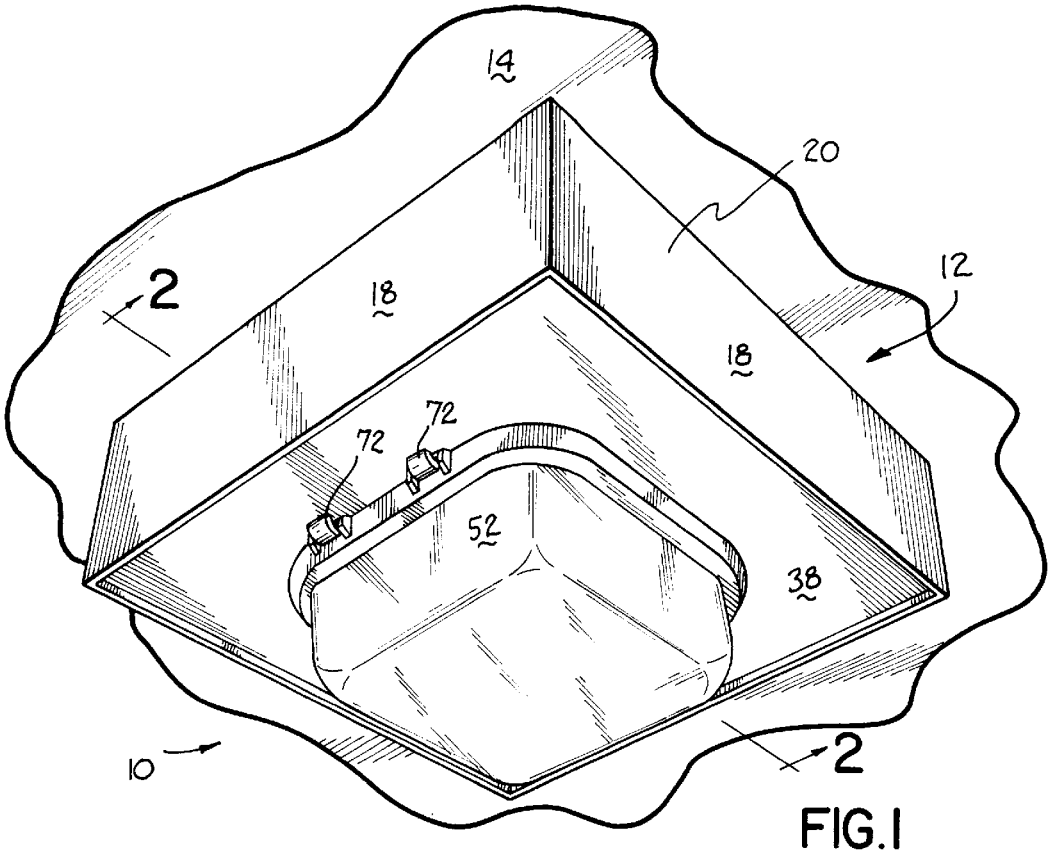
FIG. 1 is perspective view of a retrofit luminaire assembly in accordance with the principles of the present invention, shown installed in a canopy fixture housing and supported in a horizontal, operative position.

With reference to the figures, and to FIG. 1 in particular, a retrofit luminaire assembly 10 in accordance with the principles of the present invention is shown installed in an existing canopy fixture 12. Canopy fixture 12 is preferably a standard 2'×2' fixture typically found at gasoline service stations, convenience stores and drive-through restaurants, for example, which is mounted to a lower surface of a canopy 14.

Canopy fixture 12 includes a housing 20 having a horizontal top wall 16 (FIGS. 2, 5 and 6) and four vertical walls 18 which define the box-like housing. As shown most clearly in FIGS. 2, 3 and 6, the vertical walls 18 of canopy fixture 12 typically have lower edges 22 that terminate in upturned U-shaped lips 24 with integral horizontally oriented flanges 26 extending inwardly to collectively define an opening 28 in the bottom of the housing 20. The inwardly directed flanges 26, which are near the lower edges 22 of the vertical walls 18 (FIG. 5), are generally used as a mounting frame surrounding the opening 28 for securing a lens assembly (not shown) to the canopy fixture 12.

While upturned U-shaped lips 24 and inwardly directed flanges 26 are most commonly found in canopy fixtures, it will be appreciated that other mounting frame structures are possible without departing from the spirit or scope of the present invention. For example, the lower edge 22 of canopy fixture 12 may terminate in a folded hem 29 with the flanges 26 extending inwardly to collectively define the opening 28.

While not shown, those skilled in the art will appreciate that typical canopy luminaires which are to be retrofitted with the retrofit luminaire assembly of this invention include electrical control elements, such as ballasts, capacitors, and ignitors, which are generally mounted in the housing 20 of the canopy fixture 12. The electrical control elements may be mounted to one or more of the vertical walls 18 or horizontal top wall 16 of the canopy housing 20, as represented by electrical control element 30 in FIGS. 2, 5 and 6, or contained in a separate enclosure mounted remote from canopy fixture 12 (not shown). A lamp socket (not shown) is mounted within the canopy fixture housing 20 for supporting a lamp (not shown) with its longitudinal axis typically oriented in a substantially horizontal plane. A lens assembly, including a typically square metallic outer frame (not shown) and an inner transparent lens (not shown), is mounted to the inwardly directed flanges of the canopy fixture housing through screws, hinges, clips or other suitable fasteners (not shown). A resilient gasket (not shown) is typically provided between an upper peripheral edge of the lens assembly (not shown) and the lower surface of the inwardly directed flanges to provide a substantially bugproof and weatherproof seal therebetween. A curved or shaped reflector (not shown) is mounted above the lamp for directing emitted light downwardly through the lens. The electrical control elements necessary for energizing the lamp are coupled to an external power source through a first set of electrical power leads 32 (see FIGS. 2 and 5) which extend into the interior of the housing 20 through an aperture 34 formed in the top wall 16 or side wall 18 (not shown) of the canopy fixture 12. The electrical control element 30 is further coupled to the lamp socket through a second set of electrical leads 36 for energizing the lamp mounted within the lamp socket.

Figure 4A:
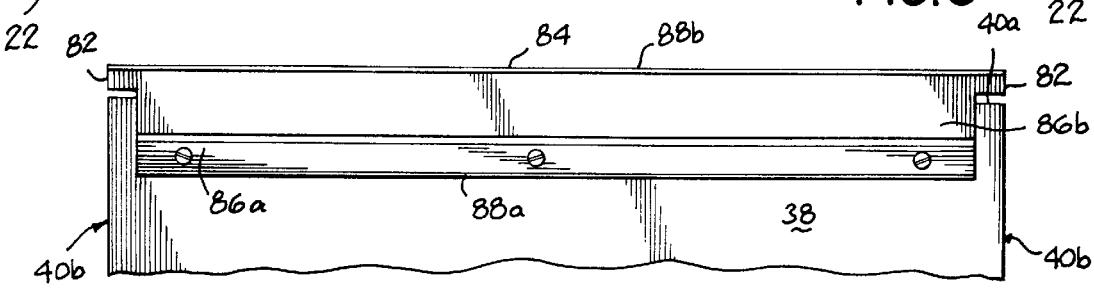
FIG. 4A is a partial top plan view of the retrofit luminaire assembly shown in FIG. 4.
Figures 2, 2A, 2B:
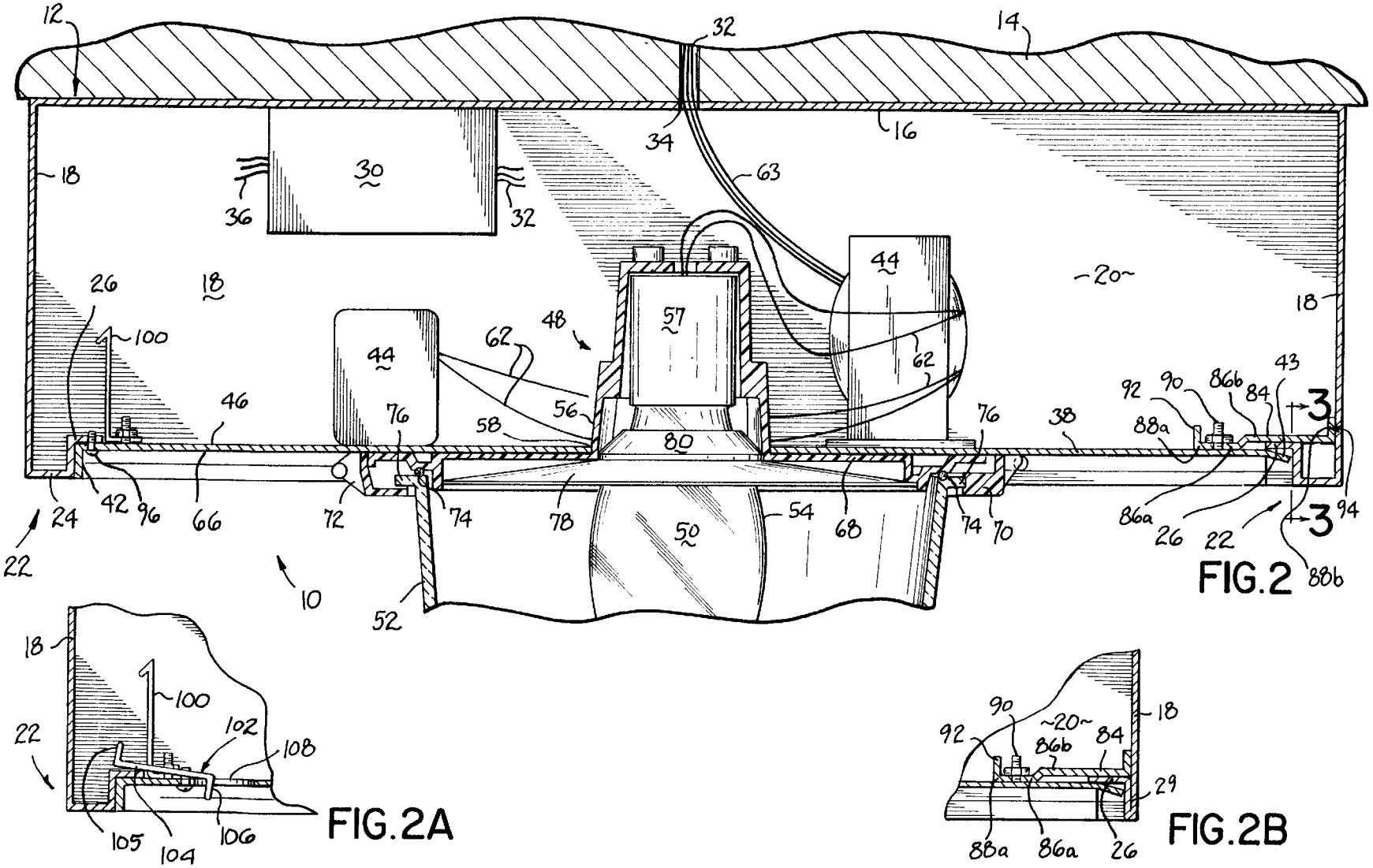
FIG. 2 is a cross-sectional view of the retrofit luminaire assembly and canopy fixture housing of FIG. 1, taken along line 2—2 of FIG. 1.
FIG. 2A is a partial cross-sectional view showing an optional latch for supporting the retrofit canopy luminaire assembly in the horizontal, operative position.
FIG. 2B is a partial cross-sectional view showing an alternative lower flange structure formed on the canopy fixture housing for supporting the retrofit canopy luminaire assembly of the present invention.

As will be described in more detail below, the retrofit luminaire assembly 10 of the present invention is constructed as a prewired and removable unit for replacing existing lighting components and related structure of an existing and installed canopy luminaire. To this end, as shown most clearly in FIGS. 2, 4 and 5, the retrofit luminaire assembly 10 includes a substantially planar panel 38, preferably made of metal, which includes a pair of parallel, opposite side edges 40*a,* 40*a* and a pair of parallel, opposite side edges 40*b,* 40*b*. Each of the edges 40*b,* 40*b,* and one of the edges 40*a* , of panel 38 preferably includes a downturned flange or skirt 42 to add strength and rigidity to the panel 38. The other edge 40*a* of panel 38 preferably includes a downwardly folded lip 43 (FIG. 2). As shown most clearly in FIG. 1, panel 38 is dimensioned to substantially cover the opening 28 in the housing 20 of canopy fixture 12 when it is installed in accordance with the present invention as will be described in more detail below.

Electrical control elements, generally designated as numeral 44, are mounted through suitable fasteners to an upper surface 46 of the panel 38 and may comprise a prewired ballast, capacitor and ignitor, for example. In a preferred embodiment of the present invention, a retrofit luminaire housing, shown generally as reference numeral 48, is mounted to panel 38 for supporting a lamp 50 and a substantially transparent lens 52 which is adapted to enclose a light-emitting section 54 of the lamp 50. A detailed description of the construction and features of a preferred luminaire housing 48 is fully set forth in commonly assigned U.S. Pat. No. 5,662,407, which is expressly incorporated herein by reference in its entirety.

In brief, the luminaire housing 48 of retrofit assembly 10 includes a narrow neck 56 which supports a lamp socket 57 (FIG. 2) within an opening in the narrow neck. The lamp socket 57 is adapted to receive a base of the lamp 50. The narrow neck 56 of retrofit luminaire housing 48 is inserted through an aperture 58 formed in the panel 38 (FIG. 2). Lamp socket 57 includes a pair of electrical contacts (not shown) which are prewired to the electrical control elements 44 through a pair of electrical leads from the set of electrical leads 62. The electrical control elements 44 include a set of electrical leads 63 having a free end which is adapted to be spliced to the incoming power electrical leads 32 extending through aperture 34 formed in top wall 16 or side wall 18 (not shown) of canopy fixture 12 during installation as will be described in more detail below. Lamp 50 is preferably a high intensity discharge lamp having its longitudinal axis oriented substantially perpendicular to the planar panel 38 to provide a distribution of light downwardly and outwardly from the canopy 14.

As shown most clearly in FIG. 2, luminaire housing 48 further includes a base 68 extending outwardly from a lower end of the narrow neck 56. The base 68 is mounted to panel 38 through fasteners (not shown) which serve to securely mount the luminaire housing 48 to the panel 38. Optionally, a spring and/or clamp structure (not shown), as described in detail in the aforementioned U.S. Pat. No. 5,662,407 incorporated herein by reference, may be used to secure the retrofit luminaire housing 48 to the panel 38. Transparent lens 52, preferably a dropped borosilicate prismatic glass refractor, is supported in a door frame 70 which is preferably hingedly connected at one side thereof to the base 68 through a pair of hinges 72. A resilient silicone gasket 74 is disposed between an upper peripheral edge or rim 76 of lens 52 and a lower surface of base 68 to form a weatherproof and bugproof seal therebetween when the door frame 70 is engaged with a latch (not shown) on the base 68. A reflector 78, such as a specular reflector, is disposed about the light-emitting section 54 of lamp 50 to direct emitted light downwardly through the lens 52. Reflector 78 has a central aperture 80 which permits passage of the lamp base therethrough and a round or rectangular outer configuration to substantially cover base 68.

Retrofit luminaire assembly 10 preferably includes a pair of oppositely directed pivot members or arms 82, 82 which are formed at opposite ends of an elongated support member 84 to support the retrofit luminaire assembly 10 during its installation in the canopy fixture 12 as will be described in detail below. Support member 84, which is preferably made of metal, has offset planar web portions 86*a* and 86*b* which are formed between opposite elongated edges 88*a* and 88*b* of the support member 84. Support member 84 is mounted to the upper surface 46 of panel 38 through fasteners 90 which extend through planar web portion 86*a.* Elongated edge 88*a* of support member 84 includes a skirt 92 extending upwardly from the planar web portion 86*a,* while the other elongated edge 88*b* terminates in an upturned lip 94. As shown most clearly in FIG. 4A, elongated edge 88*a* and planar web portions 86*a* and 86*b* preferably have a length which is less than the length between parallel, opposite side edges 40*b,* 40*b* of planar panel 38. Elongated edge 88*b* of support member 84 preferably has a length dimension which is substantially equal to the length between parallel, opposite edges 40*b,* 40*b* of planar panel 38. As a result, the oppositely directed pivot members or arms 82, 82 are formed as "fingers" which extend from the opposite ends of the support member 84 and are spaced outboard of side edge 40*a* of panel 38.

During installation of the retrofit luminaire assembly 10 in the canopy fixture 12, the existing lighting components of the canopy luminaire must first be removed. To this end, the existing lens assembly, including the metallic outer frame and inner lens, are detached from the inwardly directed flanges 26 of canopy fixture 12 and removed to provide access to the interior of housing 20. The electrical leads 32 connecting the power source (not shown) to the existing electrical control element 30 are then disconnected. If the existing lamp socket and electrical control element 30 do not interfere with installation of retrofit luminaire assembly 10, they may be left in the housing 20. Otherwise, the set of electrical leads 36 coupled between the existing electrical control element 30 and lamp socket (not shown) is disconnected, and the electrical control element 30 and lamp socket are then removed from the enclosure 20. The existing lamp, reflector and any other interfering structure are also removed to provide sufficient room in housing 20 for installation of retrofit canopy luminaire assembly 10.

Figure 3:
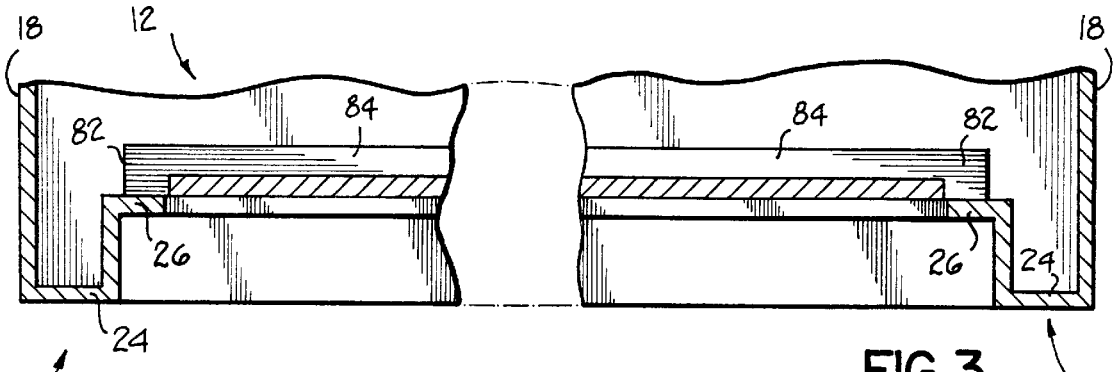
FIG. 3 is a cross-sectional view taken along line 3—3 of FIG. 2.

As shown most clearly in FIGS. 3 and 5, retrofit canopy luminaire 10 is installed in canopy fixture 12 by first engaging the pair of oppositely directed pivot members 82, 82 with an opposite pair of inwardly directed housing flanges 26, 26. The pair of oppositely directed pivot members 82, 82 overlie and are supported by the opposite pair of inwardly directed flanges 26, 26. In this position, the retrofit luminaire assembly 10 is removably and pivotally supported on the opposite pair of inwardly directed flanges 26, 26 at one end of panel 38 as shown most clearly in FIGS. 5 and 6.

After the retrofit luminaire assembly 10 has been inserted in the canopy fixture 12 with the pivot members 82, 82 engaging the inwardly directed flanges 26,26, the retrofit luminaire assembly 10 is preferably suspended in a substantially vertical, inoperative position as shown in FIG. 5 to permit splicing of electrical leads 63 with the existing incoming electrical power leads 32 from the power source (not shown).

Figure 6:
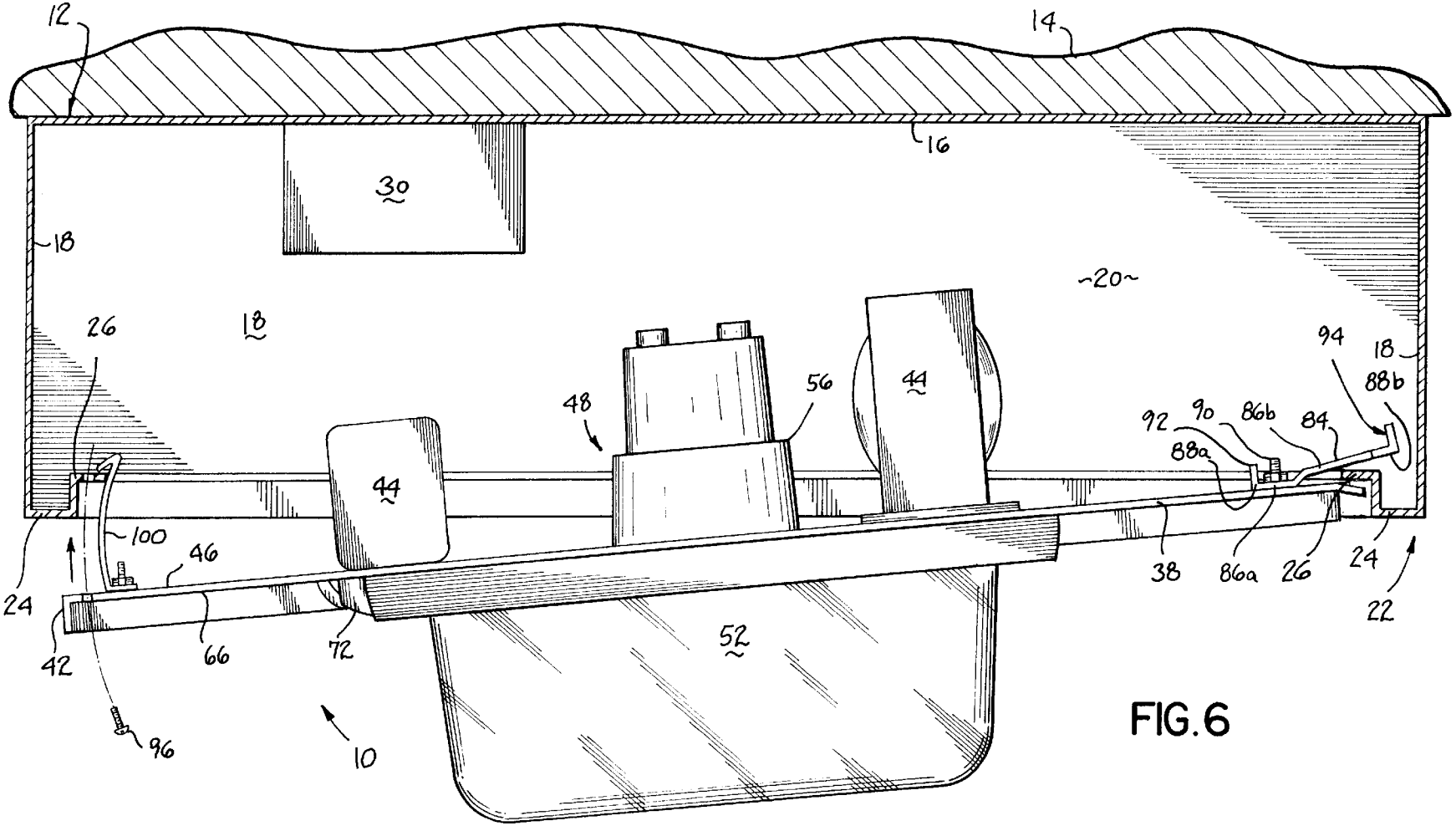
FIG. 6 is side elevational view showing the retrofit luminaire assembly of FIG. 1 supported in a partially closed position through an optional resilient clip.

After the necessary electrical connections have been made, the panel 38 is then pivoted upwardly and oriented in a horizontal, operative position as shown most clearly in FIGS. 1, 2 and 6. The offset between planar web portion 86*b* and the upper side 46 of panel 38 provides a gap for receiving the inwardly directed flange 26 as shown most clearly in FIGS. 2 and 6. In the horizontal, operative position, the retrofit luminaire assembly 10 is then secured to at least one of the inwardly directed flanges 26 of canopy fixture 12 through fasteners 96 (FIGS. 2 and 6), clips or other suitable means.

Preferably, a resilient spring clip 100 is mounted to the upper surface 46 of panel 38 at a side edge 40*a* opposite from the side edge 40*a* to which the support member 84 is mounted. The spring clip 100 extends upwardly from the upper surface 46 of panel 38 and is adapted to engage an inwardly directed flange 26 of the canopy fixture 12 to temporarily retain the panel 38 in a partially closed position as shown most clearly in FIG. 6. The spring clip 100 is provided to facilitate installation of the retrofit canopy luminaire 10 in canopy fixture 12 before holes are drilled in the inwardly directed flange 26 and fasteners 96 are secured through the holes in the inwardly directed flange 26 of canopy fixture 12. The spring clip 100 also serves as a safety catch to support panel 38 in case the fasteners 96 are removed.

As shown most clearly in FIGS. 2A and 5A, a latch 102 is preferably slidably mounted on the upper side 46 of panel 38 proximate the spring clip 100. The slidable latch 102 preferably includes a pair of horizontally oriented fingers 104 that terminate in upturned flanges 105. Fingers 104 are adapted to engage the inwardly directed flange 26 and retain the panel 38 in the horizontal, operative position when the latch is moved in the direction of the inwardly directed flange 26. As shown in FIG. 2A, the latch 102 has an actuator 106 which extends through a slot 108 in the panel 38 to permit manual operation of the latch between an "open" and "closed" position from the lower side 66 of panel 38.

Those skilled in the art will readily appreciate that the retrofit luminaire assembly of the present invention advantageously provides lighting components and related structure of the luminaire mounted and prewired as a single unit for installation in a canopy fixture. The retrofit luminaire assembly supports the lighting components and related structure as an assembled unit in the canopy fixture to simplify the installation procedure. Moreover, the retrofit luminaire assembly of the present invention is adapted to be removably and pivotally supported by the canopy fixture as a unit during the installation procedure between a vertical, inoperative position and a horizontal, operative position.

From the above disclosure of the general principles of the present invention and the preceding detailed description of preferred embodiments, those skilled in the art will readily comprehend the various modifications to which the present invention is susceptible. For example, while forming the pair of oppositely directed pivot members or arms 82, 82 integrally on support member 84 is preferred, it is contemplated in another embodiment of the present invention that the support member 84 could be replaced with one or more hooks, clips or similar structures (not shown) which mount to a side edge 40*a* of panel 38 and extend outwardly to engage one of the inwardly directed flanges 26 of canopy fixture 12. Alternatively, it is contemplated in yet another embodiment of the present invention that the oppositely directed pivot members 82, 82 could be integrally formed or mounted on panel 38 to extend outwardly from parallel, opposite edges 40*b*, 40*b* at one end of panel 38 (not shown). Moreover, it is also contemplated that retrofit luminaire assembly 10 may not require electrical control elements 44 mounted on the upper surface 46 of panel 38 when the existing electrical control element 30 is used. In this case, the electrical leads 36 of electrical control element 30 are coupled to the pair of electrical contacts (not shown) of lamp socket 57.

The invention in its broader aspects is therefore not limited to the specific details and illustrative example shown and described. Accordingly, departures may be made from such details without departing from the spirit or scope of Applicants' general inventive concept. Therefore, Applicants desire to be limited only by the full legal scope of the following claims.

Having described the invention, we claim:

1. A retrofit luminaire assembly adapted for installation in a canopy fixture housing having an inwardly directed flange at a lower end thereof surrounding and defining an opening in the canopy fixture housing, comprising:

a substantially planar panel having an upper surface and a lower surface;

a lamp mounted to said panel and having a light-emitting section extending away from the lower surface of said panel;

a substantially transparent lens mounted to the lower surface of said panel and covering the light-emitting section of said lamp; and at least one pivot member associated with said panel, said pivot member being operable to engage the flange surrounding the opening of the canopy fixture housing and removably and pivotally support said panel between a substantially vertical, inoperative position and a horizontal, operative position whereby said panel is sized to substantially close the opening in the canopy fixture housing when oriented in its horizontal, operative position.

2. The retrofit luminaire assembly of claim 1 comprising a pair of oppositely directed pivot members associated with said panel, said pivot members being operable to engage the flange surrounding the opening in the canopy fixture housing and removably and pivotally support said panel for movement between the substantially vertical, inoperative position and the horizontal, operative position.

3. The retrofit luminaire assembly of claim 1 further comprising at least one electrical control element for operating said lamp, wherein said electrical control element is mounted to the upper surface of said panel and electrically coupled to said lamp.

4. The retrofit luminaire assembly of claim 1 wherein said lamp has a longitudinal axis disposed substantially perpendicular to said planar panel.

5. The retrofit luminaire assembly of claim 1 further comprising a resilient clip associated with said panel, said resilient clip being operable to engage the flange surrounding the opening in the canopy fixture housing and retain said panel in a partially closed position intermediate the vertical, inoperative position and the horizontal, operative position.

6. The retrofit luminaire assembly of claim 5 wherein said resilient clip extends upwardly from the upper surface of said panel.

7. The retrofit luminaire assembly of claim 1 further comprising a slidable latch associated with said panel, said latch being operable to engage the flange surrounding the opening in the canopy fixture housing and retain said panel in the horizontal, operative position when said latch is moved in a direction toward the flange.

8. The retrofit luminaire assembly of claim 2 wherein said oppositely directed pivot members are formed at opposite ends of an elongated support member mounted to said panel.

9. The retrofit luminaire assembly of claim 1 wherein said lens is hingedly mounted on the lower surface of said panel.

10. A retrofit luminaire assembly adapted for installation in a canopy fixture housing having an inwardly directed flange at a lower end thereof surrounding and defining an opening in the canopy fixture housing, comprising:

a substantially planar panel having an upper surface and a lower surface;

a retrofit luminaire housing mounted to said panel, said retrofit luminaire housing having a narrow neck for supporting a lamp socket therein and a base extending outwardly from a lower end of said narrow neck;

a lens enclosing a light-emitting section of a lamp having its base inserted in said lamp socket, said lens having an upper peripheral edge secured to said retrofit luminaire housing base; and at least one pivot member associated with said panel, said pivot member being operable to engage the flange surrounding the opening in the canopy fixture housing and removably and pivotally support said panel between a substantially vertical, inoperative position and a horizontal, operative position whereby said panel is sized to substantially close the opening in the canopy fixture housing when oriented in its horizontal, operative position.

11. The retrofit luminaire assembly of claim 10 comprising a pair of oppositely directed pivot members associated with said panel, said pivot members being operable to engage the flange surrounding the opening in the canopy fixture housing and removably and pivotally support said panel for movement between the substantially vertical, inoperative position and the horizontal, operative position.

12. The retrofit luminaire assembly of claim 10 further comprising at least one electrical control element for operating said lamp, wherein said electrical control element is mounted to the upper surface of said panel and electrically coupled to said lamp socket.

13. The retrofit luminaire assembly of claim 10 wherein said lens is hingedly mounted to the base of said retrofit luminaire housing.

14. The retrofit luminaire assembly of claim 10 further comprising a resilient clip associated with said panel, said resilient clip being operable to engage the flange surrounding the opening in the canopy fixture housing and retain said panel in a partially closed position intermediate the vertical, inoperative position and the horizontal, operative position.

15. The retrofit luminaire assembly of claim 14 wherein said resilient clip extends upwardly from the upper surface of said panel.

16. The retrofit luminaire assembly of claim 10 further comprising a slidable latch associated with said panel, said latch being operable to engage the flange surrounding the opening in the canopy fixture housing and retain said panel in the horizontal, operative position when said latch is moved in a direction toward the flange.

17. The retrofit luminaire assembly of claim 11 wherein said oppositely directed pivot members are formed at opposite ends of an elongated support member mounted to said panel.

18. The retrofit luminaire assembly of claim 10 further comprising a resilient gasket disposed between an upper peripheral edge of said lens and the base of said retrofit luminaire housing for providing a seal therebetween.

19. The retrofit luminaire assembly of claim 10 further comprising a reflector disposed about the light-emitting section of said lamp and adapted to direct light emitted from said lamp through said lens.

20. A method of installing a retrofit luminaire assembly in an existing canopy fixture having a housing with an inwardly directed flange at a lower end thereof surrounding and defining an opening in the canopy fixture housing, said canopy fixture housing further having a ballast coupled to a power source through a first set of electrical leads, a first lamp socket coupled to the ballast through a second set of electrical leads, a lamp mounted in the first lamp socket, a reflector and a lens assembly covering the opening, comprising:

removing the lens assembly from the canopy fixture housing to expose the interior of the housing through the opening therein;

disconnecting the first set of electrical leads coupled to the ballast;

removing at least the lamp and the reflector from the canopy fixture housing;

providing a substantially planar panel having an upper surface and a lower surface;

providing a second lamp socket mounted to said panel for receiving a base of a lamp and orienting its light-emitting section extending away from the lower surface of said panel;

providing a lens mounted to the lower surface of said panel for enclosing the light-emitting section of said lamp;

providing at least one electrical control element for operating said lamp, said electrical control element being mounted to the upper surface of said panel and electrically coupled to said second lamp socket;

providing at least one pivot member associated with said panel;

engaging the pivot member on the flange surrounding the opening in the canopy fixture housing for removably suspending the panel in a substantially vertical, inoperative position;

coupling the first set of electrical leads from the power source to the electrical control element;

pivoting the panel to a horizontal, operative position whereby said panel substantially closes the opening in the canopy fixture housing; and securing said panel in the horizontal, operative position.

21. The method of claim 20 comprising:

providing a pair of oppositely directed pivot members associated with said panel; and engaging the pair of oppositely directed pivot members with the flange surrounding the opening in the canopy fixture housing for removably suspending the panel in the substantially vertical position.

22. The method of claim 20 further comprising:

disconnecting the second set of electrical leads coupled to the first lamp socket; and removing the first lamp socket from the canopy fixture housing.

23. The method of claim 20 further comprising:

disconnecting the second set of electrical leads coupled to the first lamp socket; and removing the ballast from the canopy fixture housing.

24. The method of claim 20 further comprising:

providing a reflector about the light-emitting section of said lamp for directing light emitted from said lamp through said lens.

25. A method of installing a retrofit luminaire assembly in an existing canopy fixture having a housing with an inwardly directed flange at a lower end thereof surrounding and defining an opening in the canopy fixture housing, said canopy fixture housing further having a ballast coupled to a power source through a first set of electrical leads, a first lamp socket coupled to the ballast through a second set of electrical leads, a lamp mounted in the first lamp socket, a reflector and a lens assembly covering the opening, comprising:

removing the lens assembly from the canopy fixture housing to expose the interior of the housing through the opening therein;

disconnecting the second set of electrical leads coupled to the first lamp socket;

removing at least the lamp and the reflector from the canopy fixture;

providing a substantially planar panel having an upper surface and a lower surface;

providing a second lamp socket mounted to said panel for receiving a base of a lamp and orienting its light-emitting section extending away from the lower surface of said panel;

providing a lens mounted to the lower surface of said panel for enclosing the light-emitting section of said lamp;

providing at least one pivot member associated with said panel;

engaging the pivot member with the flange surrounding the opening in the canopy fixture housing for removably suspending the panel in a substantially vertical, inoperative position;

coupling the second set of electrical leads from the ballast to the second lamp socket;

pivoting the panel to a horizontal, operative position whereby said panel substantially closes the opening in the canopy fixture housing; and securing said panel in the horizontal, operative position.

26. The method of claim 25 comprising:

providing a pair of oppositely directed pivot members associated with said panel; and engaging the pair of oppositely directed pivot members with the flange surrounding the opening in the canopy fixture housing for removably suspending the panel in the substantially vertical position.

27. The method of claim 25 further comprising:

removing the first lamp socket from the canopy fixture housing.

28. The method of claim 25 further comprising:

providing a reflector about the light-emitting section of said lamp for directing light emitted from said lamp through said lens.

* * * * *